United States Patent [19]

Sansky

[11] Patent Number: 4,843,374

[45] Date of Patent: Jun. 27, 1989

[54] DOOR ANNUNCIATOR

[76] Inventor: Michael J. Sansky, 10 Hughes St., #A-101, Irvine, Calif. 92718

[21] Appl. No.: 175,201

[22] Filed: Mar. 30, 1988

[51] Int. Cl.[4] ..... G08B 13/08

[52] U.S. Cl. ..... 340/547; 200/61.93; 200/61.62

[58] Field of Search ..... 340/547; 200/61.93, 200/61.62

[56] References Cited

U.S. PATENT DOCUMENTS

| | | | |
|---|---|---|---|
| 3,938,120 | 2/1976 | O'Connell | 340/545 |
| 3,978,467 | 8/1976 | Albert | 340/545 |
| 4,006,451 | 2/1977 | Nobile | 340/63 |
| 4,160,972 | 7/1979 | La Mell et al. | 340/547 |
| 4,194,193 | 3/1980 | McDonough | 340/545 |
| 4,258,358 | 3/1981 | Lee et al. | 340/547 |
| 4,276,545 | 6/1981 | Jarvis et al. | 340/547 |
| 4,278,968 | 7/1981 | Arnett et al. | 340/547 |
| 4,282,518 | 8/1981 | Bonner | 340/545 |
| 4,583,082 | 4/1986 | Naylor | 340/545 |

*Primary Examiner*—Glen R. Swann, III

*Attorney, Agent, or Firm*—Fulwider, Patton, Lee & Utecht

[57] ABSTRACT

A door annunciator briefly sounds an alarm when a door opens but not when the door closes. When the door begins to open, a reed switch makes a connection so that an electrical current resulting from a change in the amount of electrical charge stored in a capacitor triggers an electronic alarm chip and thereby causes the alarm to sound. When the door closes the switch connects the capacitor to restore its original level of charge. The components are installed in a small self-contained enclosure adjacent the door, and a permanent magnet to operate the reed switch as the door opens and closes is installed on the door.

7 Claims, 1 Drawing Sheet

DOOR ANNUNCIATOR

BACKGROUND OF THE INVENTION

The present invention relates generally to alarm systems and more particularly to an annunciator which activates an alarm signal upon opening of a door.

There are many instances in which there is a requirement for an alarm to sound automatically upon the opening of a door. For example, in retail establishments such an alarm is needed to alert a salesperson if someone enters. A simple alarm system which sounds upon the opening of a door includes a switch which is engaged by the door whenever the door is fully shut in its frame. As soon as the door begins to open it disengages from the switch and the switch contact is thereupon activated to sound the alarm. A disadvantage of such a system is that the alarm sounds continuously whenever the door is not fully shut, and if the door remains open for more than a few seconds the continuously-sounding alarm becomes highly annoying.

To eliminate the annoyance of a continuously-sounding alarm, it has been proposed to utilize a switch which is momentarily activated by relative movement between the door and the switch. Thus, as the door is being opened it moves past the switch and momentarily sounds the alarm. However, as the door is being closed it again moves past the switch and again sounds the alarm, and this second sounding of the alarm has also been found to be annoying.

This problem could be overcome by a switch mechanism which responds to movement of the door in only one direction, and such mechanisms have been proposed. However, these mechanisms tend to be relatively complex. They are also subject to damage because they frequently project out from the door frame and get in the way. Moreover, two such mechanisms are generally required if the door is of the kind that can open either in or out.

It will be apparent from the foregoing that there is a need for a simple, economical door annunciator system which sounds an alarm briefly upon opening of a door but not upon a subsequent closing of the door.

SUMMARY OF THE INVENTION

The present invention provides a door annunciator which includes a switch operable to connect a capacitor or the like to provide electrical energy to briefly sound an alarm when a door is opened and to disconnect the capacitor when the door is closed, thereby providing an economical, mechanically simple annunciator system which sounds an alarm only when the door is being opened.

A door annunciator according to the invention includes alarm means such as an electronic chime which provides a perceptible alarm signal in response to an energizing input signal; energizing means operable to provide an energizing input signal to the alarm means for a short time; a battery or other source of electrical energy; and switch means, operative to couple the energy source to the energizing means upon location of a door in a first position with respect to the switch means and to decouple the energy source from the energizing means upon location of the door in a second position whereby the alarm provides the alarm signal upon opening of the door but not upon closing thereof.

In a preferred embodiment a door annunciator is housed in a pair of annunciator enclosures, the first adapted for installation on a door frame adjacent an edge of a door and the second adapted for installation on the door. The enclosures are located such that they are adjacent one another when the door is closed, the door being operative to carry the second enclosure away from the first while opening and toward the first while closing. A switch activation means is installed in one of the enclosures and the switch means is installed in the other. The alarm means, the energizing means and the energy source either are housed in the same enclosure as the switch means to provide a completely self-contained system or are remotely located if convenient.

The energizing means comprises, for example, a capacitor operative to charge from the electrical energy source while the door is in the first position and to discharge while the door is in the second position.

In a preferred embodiment the switch means comprises a reed switch and the switch activation means comprises a permanent magnet. The reed switch includes a switch contact which connects the capacitor to charge through the alarm means when the door opens, the charging current being sufficient to cause the alarm signal to be provided for a short time until the capacitor approaches full charge and the charging current diminishes. Then when the door closes, the connection is changed, and the capacitor discharges.

In an alternate embodiment the capacitor is connected to charge while the door is closed and to discharge through the alarm means when the door opens.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
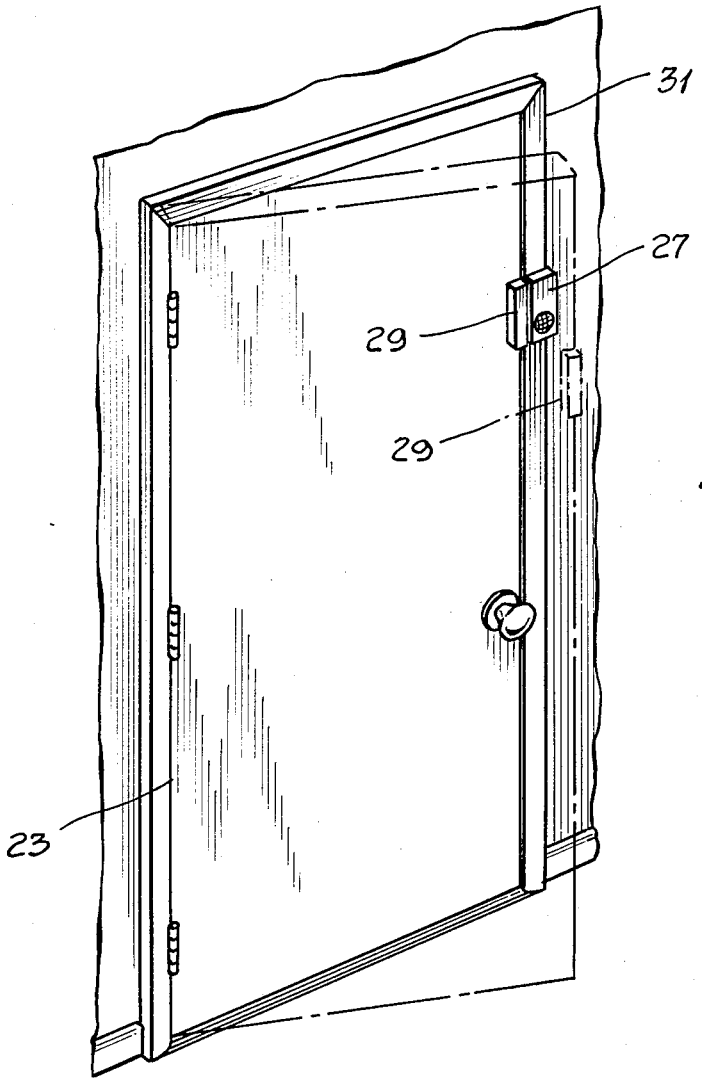
FIG. 1 is a perspective view of a door annunciator according to the invention installed on a door.

As shown in the drawings for purposes of illustration, the invention is embodied in a novel door annunciator which briefly sounds an alarm when a door opens but not when the door closes. Existing door annunciators annoyingly sound the alarm continuously when the door is open or whenever the door either opens or closes, or rely on complex, damage-prone mechanical devices.

In accordance with the invention, a door annunciator includes a switch operable to connect an energizing means to provide electrical energy to briefly sound an alarm when the door is opened and to disconnect the energizing means when the door is closed, thereby providing an economical, mechanically simple alarm system which sounds only when the door is being opened.

Figure 2:
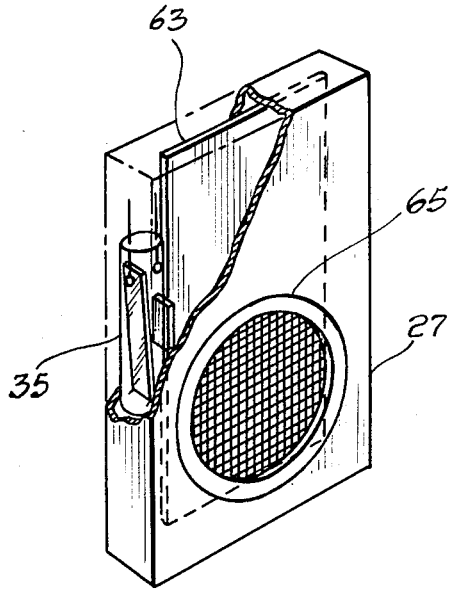
FIG. 2 is an enlarged perspective view of the annunciator of FIG. 1 with the enclosure shown partially cut away.
Figure 3:
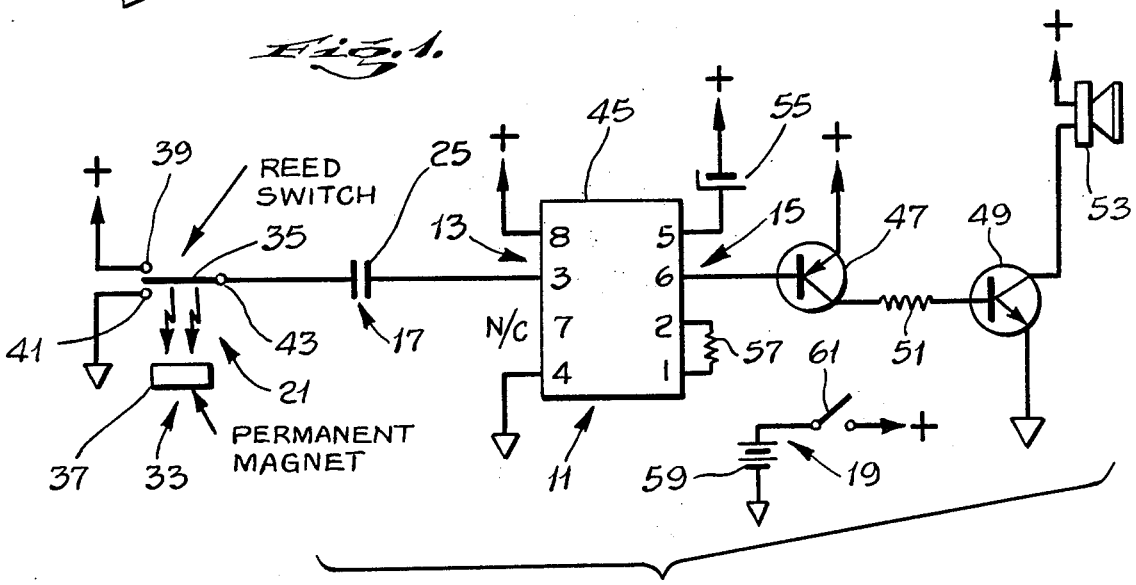
FIG. 3 is a schematic diagram of the annunciator of FIG. 1.

More particularly, as shown in FIGS. 1 through 3 a door annunciator according to the invention includes alarm means 11, responsive to an energizing input signal at an input point 13 to provide a perceptible alarm signal at an output point 15; energizing means 17, operable to provide an energizing input signal to the alarm means 11 for a limited interval of time; a source 19 of electrical energy; and switch means 21, operative to couple the energy source 19 to the energizing means 17 upon location of a door 23 in a first position with respect to the switch means 21 and to decouple the energy source 19 from the energizing means 17 upon location of the door 23 in a second position whereby the alarm means 11 provides the alarm signal upon opening of the door 23 but not upon closing thereof.

The energizing means 17 preferably comprises a capacitor 25 operative to charge from the energy source 19 while the door 23 is in the first position and to discharge while the door 23 is in the second position.

In a preferred embodiment a door annunciator according to the invention is housed in a pair of annunciator enclosures 27 and 29, the first enclosure 27 adapted for installation on a door frame 31 adjacent an edge of the door 23 and the second enclosure 29 adapted for installation on the door 23 in a position which is adjacent the first enclosure 27 when the door 23 is closed, the door being operative to carry the second enclosure 29 away from the first enclosure 27 while opening, as shown in broken lines in FIG. 1, and toward the first enclosure 27 while closing.

Switch activation means 33 is located in one of the enclosures, for example the second enclosure 29 carried by the door, and the switch means 21 is located in the other enclosure. The alarm means 11, the energizing means 17 and the energy source 19 are located in the same enclosure as the switch means 21 to provide a completely self-contained system or can be remotely located if desired.

In the embodiment shown in FIG. 3 the switch means 21 comprises a single pole double throw reed switch 35 and the switch activation means 33 comprises a permanent magnet 37. The switch means 21 includes a normally-closed contact 39 connected to a positive terminal (designated "V+") of the energy source 19, a normally-open contact 41 connected to ground, and a common contact 43 connected to a first plate of the capacitor 25. When the door 23 is closed, the reed switch 35 is located adjacent the magnet 37 and the magnet 37 exerts a force which moves the common contact 43 into connection with the normally-open contact 41. When the door 23 opens, the magnet 37 is moved away from the switch 35, releasing the common contact 43. This breaks the connection between the contact 43 and the normally-open contact 41 and establishes a connection between the common contact 43 and the normally-closed contact 39.

The alarm means 11 comprises, for example, a melody chip 45 such as a type 7920AT having an input pin #3 which receives the energizing input signal at the input point 13. The input point 13 is connected to a second plate of the capacitor 25.

The chip 45 has an output pin #6 which provides the output signal at the output point 15. The output point 15 is connected to a base of a PNP transistor 47 such as a type 2N2709. An emitter of the transistor 47 is connected to V+ and a collector thereof is connected to a base of an NPN transistor 49 such as a type 2N222 through a resistor 51. An emitter of the transistor 49 is connected to ground and a collector thereof is connected to a first terminal of a loudspeaker 53. A second terminal of the loudspeaker 53 is connected to V+.

Other circuit connections of the chip 45 include a pin #8 connected to V+, a pin #4 connected to ground, a pin #5 connected through a capacitor 55 to V+, and a pin #1 connected to a pin #2 through a resistor 57.

The energy source 19 comprises a battery 59 having a negative terminal connected to ground and a positive terminal connected to a first contact of a power switch 61. A second terminal of the power switch 61 is connected to V+ to provide operating power to the circuit. A 9-volt transistor radio battery gives satisfactory results and ordinarily lasts for many months because virtually no current is drawn except while the door is open.

The values of the components in this circuit are not critical. Satisfactory results are obtained by using a 3.3 microfarad capacitor for the capacitor 25, a 33 microfarad capacitor for the capacitor 55, a 330 ohm resistor for the resistor 51, and a one megohm resistor for the resistor 57.

As best shown in FIG. 2, all of the components of the annunciator (except the permanent magnet 37) are conveniently housed in the enclosure 27. The reed switch 35 is located adjacent a side of the enclosure 27 and the other components are mounted on a printed circuit board 63 or the like. A grille 65 covers and protects the loudspeaker 53 and provides an outlet for sound.

When the door 23 is closed, the reed switch 35 is located near the magnet 37 and the force exerted by the magnet 37 holds the common contact 43 in connection with the normally-open contact 41, grounding the capacitor 25. When the door 23 begins to open, the magnet 37 is carried away from the reed switch 35, releasing the common contact 43 from the normally-open contact 41. As the common contact 43 is released, it establishes a connection with the normally-closed contact 39 and allows a charging current to flow into the capacitor 25. This charging current flows through the capacitor 25 into the input pin #3 of the chip 45, triggering the chip 45 to commence playing a musical tune. This tune is amplified by the transistors 47 and 49 and provided to the loudspeaker 53.

Once the chip 45 has been triggered, it continues to play its tune until the tune has been completed. Meanwhile, the capacitor 25 approaches full charge and the charging current diminishes. By the time the chip 45 has finished playing its tune, the charging current has become too small to again trigger the chip 45, and the tune is not played again.

When the door closes, the magnet 37 comes into proximity with the switch 35, causing the common contact 43 to again establish a connection with the normally-open contact 41, grounding the capacitor and quickly discharging it. Then when the door opens again the entire cycle is repeated.

From the above discussion it will be apparent that the chip 45 sounds its alarm one time for each opening of the door 23 but not when the door 23 closes.

From the foregoing it will be appreciated that the door annunciator system of the invention provides a mechanically simple, economical apparatus for briefly sounding an alarm each time a door opens but not when the door closes. The annunciator is conveniently mounted in an unobtrusive enclosure adjacent the door and is operable for extended periods of time from a self-contained battery.

Although several specific embodiments of the invention have been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

I claim:

1. A door annunciator comprising:

alarm means responsive to an energizing input signal to provide a perceptible alarm signal;

energizing means operable to provide an energizing input signal to the alarm means for a limited interval of time;

a battery; and switch means operative to couple the battery to the energizing means upon location of a door in an open position with respect to the switch means and to decouple the battery from the energizing means upon location of the door in a closed position whereby the alarm means provides the alarm signal upon opening of the door but not upon closing thereof and whereby there is no energy drainage from the battery in the closed position of the door.

2. A door annunciator according to claim 1 wherein the switch means comprises a reed switch.

3. A door annunciator according to claim 1 wherein the energizing means comprises a capacitor operative to charge from the battery while the door is in the open position and to discharge while the door is in the closed position.

4. A door annunciator comprising:

a first annunciator enclosure adapted for installation on a door frame adjacent an edge of a door;

a second annunciator enclosure adapted for installation on the door in a position which is adjacent the first enclosure when the door is closed, the door being operative to carry the second enclosure away from the first enclosure while opening and toward the first enclosure while closing;

alarm means responsive to an energizing input signal to provide a perceptible alarm signal;

energizing means operable to provide an energizing input signal to the alarm means for a limited interval of time;

a battery;

switch activation means located in one of the enclosures; and switch means, located in the other of the enclosure and operative to couple the battery to the energizing means upon location of the door in an open position with respect to the switch means and to decouple the battery from the energizing means upon location of the door in a closed position whereby the alarm means provides the alarm signal upon opening of the door but not upon closing thereof and whereby there is no energy drainage from the battery in the closed position of the door.

5. A door annunciator according to claim 4 wherein the alarm means, the energizing means and the battery are located in the same enclosure as the switch means.

6. A door annunciator according to claim 4 wherein the switch means comprises a reed switch and the switch activation means comprises a permanent magnet.

7. A door annunciator according to claim 4 wherein the energizing means comprises a capacitor operative to charge from the battery while the door is in the open position and to discharge while the door is in the closed position.

* * * * *